US008196744B2

(12) United States Patent
Albrecht et al.

(10) Patent No.: US 8,196,744 B2
(45) Date of Patent: Jun. 12, 2012

(54) PACKAGING UNIT FOR PIPE SECTIONS

(75) Inventors: Volker Albrecht, Lingenfeld (DE); Claus Bissinger, Kleinkarlbach (DE)

(73) Assignee: Saint-Gobain Isover, Courbevoie (FR)

( * ) Notice: Subject to any disclaimer, the term of this patent is extended or adjusted under 35 U.S.C. 154(b) by 11 days.

(21) Appl. No.: 13/037,952

(22) Filed: Mar. 1, 2011

(65) Prior Publication Data

US 2011/0162991 A1 Jul. 7, 2011

Related U.S. Application Data

(63) Continuation of application No. 11/913,469, filed as application No. PCT/EP2006/004209 on May 4, 2006, now abandoned.

(30) Foreign Application Priority Data

May 4, 2005 (DE) ..... 10 2005 020 892

(51) Int. Cl.
*B65D 85/20* (2006.01)

(52) U.S. Cl. ..... 206/443; 206/446; 206/391; 100/3

(58) Field of Classification Search ..... 206/446, 206/497, 586, 432, 321, 389, 391, 443; 100/3
See application file for complete search history.

(56) References Cited

U.S. PATENT DOCUMENTS

| | | | | |
|---|---|---|---|---|
| 864,975 | A | 9/1907 | Luce | |
| 2,050,791 | A | 8/1936 | Graham | |
| 2,584,241 | A * | 2/1952 | Stewart | 206/451 |
| 2,620,921 | A * | 12/1952 | Schaller | 206/326 |
| 2,783,598 | A | 3/1957 | Wolven | |
| 3,136,104 | A | 6/1964 | Geer | |
| 3,367,560 | A | 2/1968 | Johnson | |
| 3,537,226 | A | 11/1970 | Le Van | |
| 3,547,259 | A * | 12/1970 | Jaeschke et al. | 206/391 |
| 3,587,201 | A | 6/1971 | Strayer | |
| 3,764,351 | A * | 10/1973 | Whittington et al. | 206/443 |
| 3,809,223 | A | 5/1974 | Kendall | |
| 3,837,138 | A | 9/1974 | Terry | |
| 3,949,932 | A | 4/1976 | Shore | |
| 4,361,232 | A | 11/1982 | Olmsted | |
| 4,409,776 | A | 10/1983 | Usui | |

(Continued)

FOREIGN PATENT DOCUMENTS

CN 1555471 12/2004

(Continued)

*Primary Examiner* — J. Gregory Pickett
*Assistant Examiner* — Blaine Neway
(74) *Attorney, Agent, or Firm* — Werner Norcross & Judd LLP

(57) ABSTRACT

The present invention concerns a packaging unit (1) for several pipe sections (2) of mineral wool with a packaging material (5), which surrounds the several pipe sections (2) to form the packaging unit (1), with the packaging material (5) arranged around the pipe sections (2) under pressure, the pipe sections (2) are folded within the packaging unit (1) with reduction of the pipe section cavity, and the pipe sections (2) are formed elastically such that, in the folded state, recovery forces for restoring the unfolded initial shape are built up. By means of the packaging unit (1) of the invention, several pipe sections (2) can be transported and stored very economically. In this connection, pipe sections (2) are not restricted in their functionality, but, after removal from packaging unit (1), may be used directly and without restriction, e.g., to insulate chimneys.

9 Claims, 4 Drawing Sheets

U.S. PATENT DOCUMENTS

Figure 1:
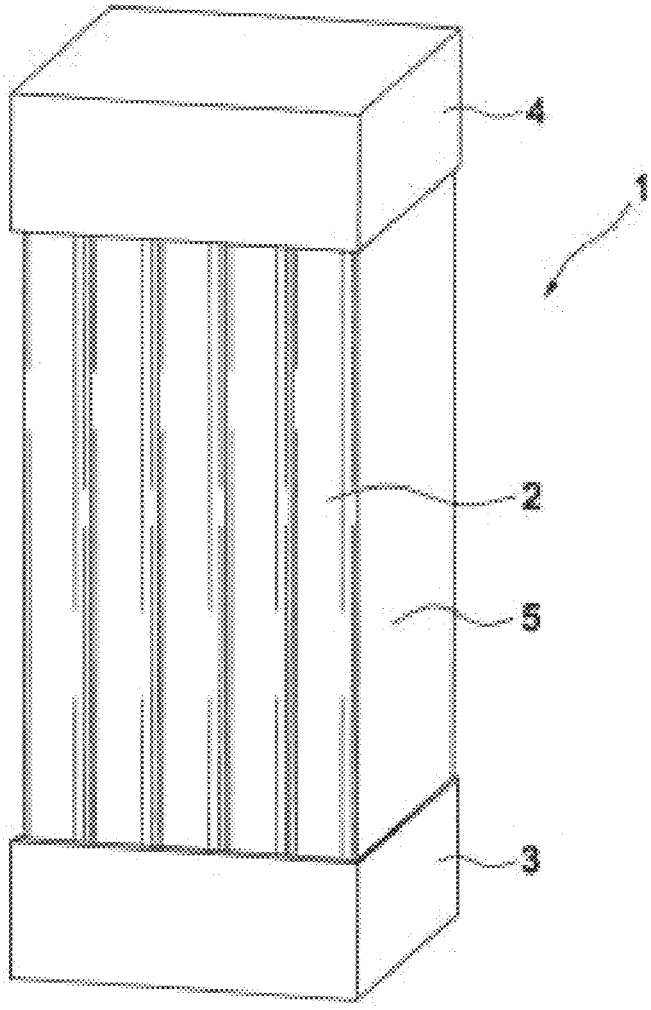

| | | | | |
|---|---|---|---|---|
| 4,444,311 | A * | 4/1984 | Rias | 206/391 |
| 4,535,587 | A * | 8/1985 | Rias | 53/436 |
| 4,625,864 | A | 12/1986 | Nigrelli | |
| 4,909,388 | A | 3/1990 | Watanabe | |
| 5,080,281 | A | 1/1992 | Seabold | |
| 5,395,665 | A | 3/1995 | Planeta | |
| 5,718,338 | A | 2/1998 | Yucknut et al. | |
| 5,743,248 | A | 4/1998 | Jansen | |
| 2004/0258865 | A1 | 12/2004 | Jessen | |
| 2006/0141177 | A1 | 6/2006 | Ligtenberg et al. | |
| 2008/0156681 | A1 * | 7/2008 | Albrecht et al. | 206/446 |

FOREIGN PATENT DOCUMENTS

| | | |
|---|---|---|
| DE | 3418951 | 3/1984 |
| DE | 4005541 | 8/1991 |
| EP | 0220980 | 5/1987 |
| EP | 1106531 | 6/2001 |
| GB | 864856 | 4/1961 |
| GB | 2102728 | 8/1982 |
| GB | 0119032 | 9/1984 |
| JP | 53008275 | 1/1978 |
| JP | 61144080 | 7/1986 |
| JP | 2005082217 | 3/2005 |
| JP | 2005112399 | 4/2005 |
| WO | 95/24147 | 9/1995 |
| WO | 9830471 | 7/1998 |
| WO | 03/008854 A2 | 1/2003 |

* cited by examiner

PACKAGING UNIT FOR PIPE SECTIONS

The present invention concerns a packaging unit for pipe sections of mineral wool as defined in the generic term of claim 1.

Such pipe sections are used as so-called insulation sections for insulating pipes, especially in the area of chimney insulation, in shipbuilding or in industrial plant. These pipe sections are generally in the form of whole pipes, that is, not of pipe halves, with a cavity present in their interior that is not used during the transport and storage of the pipe sections. From this results a large space requirement, which manifests itself in increased costs for transport and storage of the pipe sections.

Object of the present invention is to make available a packaging unit for several pipe sections that renders transport and storage of the pipe sections more economical, without the pipe sections suffering loss of functionality, but rather, after having been removed from the packaging unit can be used without restriction, e.g. for insulating chimneys.

This object is achieved in this invention with a packaging unit in accordance with claim 1. Preferred embodiments of this packaging unit are the object of the dependent subclaims.

In accordance with the invention, the packaging unit for several pipe sections of mineral wool comprises a packaging material that surrounds the several pipe sections for forming the packaging unit with a pressure such that the pipe sections are accommodated within the packaging unit in a folded state that reduces the pipe section cavity. Essential to the packaging unit of the invention is that the pipe sections are formed so as to be elastic enough to build up recovery forces in the folded state for restoring the unfolded initial shape, with the result that the pipe sections fold out completely to their original state after the pressure has been removed.

With the aid of this packaging unit, several pipe sections can thus be stored and transported in a space-saving manner and thus very economically, as the cavity in their interior can in principle be reduced to zero because of the folding of the pipe sections. Depending on the shape of the pipe sections, the folding process can additionally reduce the external free space, i.e. the cross-sectional free surface generated between the outer circumference of one pipe section and a rectangular, enveloping one touching the outer circumference. The result is that the cavities in a packaging unit of several pipe sections can thus be minimised very efficiently. At the same time, the elastic formation of the pipe sections ensures, however, that the pipe sections fully spring back to their original shape without fibre breakage when the packaging unit has been opened and so may be used directly without any further processing stages, e.g. for insulating chimneys.

This packaging unit is suitable for all kinds of pipe sections that have an interior cavity, especially for those with angular, especially rectangular, oval and circular cross-section. The preferred material for the pipe sections is mineral wool having a composition in accordance with EP 03 02 2609. Such mineral wool has a bulk density between 60 and 130 kg/m$^3$, possesses the requisite elasticity and, in comparison with normal rock wool, has much improved insulating properties for the same bulk density. This mineral advantageously combines the properties of rock wool and glass wool and especially has a melting point exceeding 1000° C. On the other hand, pipe sections of glass wool or rock wool are suitable, provided it is ensured that the pipe sections build up adequate elastic recovery forces during deformation.

In accordance with a preferred embodiment, the packaging material is a packaging film of plastic, especially a waterproof film, such as polyethylene, polypropylene or polyamide film.

This is preferably attached by bonding or is formed as a shrink-fit film. To facilitate transport, provision may be made on the packaging unit for a handle, which especially is formed from a film strip connected to the packaging material.

Advantageously, the packaging unit comprises at least a piece of cardboard, which is at least the size of one side-face of the packaging unit and preferably is surrounded by the packaging material. By virtue of this cardboard, the packaging unit receives a relatively rigid form and additionally is given a quadratic shape, which makes the packaging unit easy to stack. In the simplest manner, provision can be made for the cardboard as a rectangular area on one side of the packaging unit. However, embodiments are expedient which surround several adjacent, e.g. three, sides of the packaging unit, such that dimensionally stable edges and corners are formed. It is especially preferable for both ends of the packaging unit to be boxed, i.e. surrounded on five sides by cardboard, such that the packaging unit has a quadratic structure.

In a further preferred embodiment, the packaging unit may be formed only from box-like cardboard elements arranged on both sides, without further film packaging. This is especially of interest when, given an arrangement of several such packaging units in a larger container, individual weathering and transport protection by this film packaging can be eschewed, by, for example, surrounding the large container completely in a film that offers weathering and transport protection.

Alternatively, the packaging material may also be formed in the shape of banderols surrounding the pipe sections, whereby provision has to be made here for an adequate number of banderols in order that undesirable bulging effects of the packaged pipe sections may be limited. Such banderols may, for example, be formed as film strips or as barrel hoops, with these having to have a corresponding width to prevent them from cutting into the pipe sections. Especially preferred here are three banderols, of which two are arranged close to the ends of the packaging unit and the third is in the middle. This packaging form may also be especially suitable if individual weather and transport protection can be eschewed.

In a further preferred embodiment, the packaging unit is formed such that the pipe section are folded relative to a principal dimension. A principal dimension of this kind may be the inner diameter of the pipe sections, with the pipe sections assuming an elliptical cross-section in the folded state. In the case of, e.g., pipe sections with a rectangular cross-section, the principal dimension is the shorter side. Accordingly, the principal dimension, irrespective of the cross-sectional shape, is that side which has to be folded the least in order that the same compression of the interior cavity of the pipe section may be obtained.

Preferably, the pipe sections in the packaging unit are folded only to the extent that the mineral wool remains largely uncompressed. This ensures that the mineral fibres themselves do not break and that the elastic properties of the pipe sections are not diminished.

In the event of compression of the mineral wool of the pipe section beyond that of folding, it must be ensured that the elastic properties of the pipe section are not diminished as a result.

In a preferred further development of the packaging unit, the pipe sections are arranged behind each other in respect of the direction of folding, i.e. in a line, such that the packaging unit is as slim as possible, as a result of which handling of the packaging unit is improved.

Preferably, one packaging unit contains three, four or five pipe sections, with each pipe section having a length of 1 m. In this way, the consumer can simply compose various lengths for insulation with the pipe sections, without any appreciable material surplus being generated. These individual contingents of three, four or five pipe sections thus conduce to material-saving and ultimately cost-saving purchasing of required pipe sections. Usually, such pipe sections are used in the insulation of chimneys. Chimneys are for the most part between 6 and 12 m in length. The length of 6 m could thus be covered by two packaging units of three pipe sections each, a chimney length of 7 m could be covered by one packaging unit of 4 pipe sections and further one of 3 pipe sections, etc.

Of further advantage is to laminate aluminum foil to the exterior and/or interior of the pipe sections. This lamination serves on one hand to protect the pipe sections, e.g. when lying directly against each other, and on the other makes it possible to insert folded pipe sections into unfolded ones and so to make further space savings.

Figure 2:
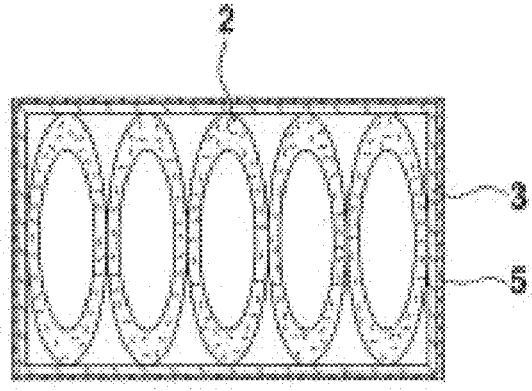
Figure 3:
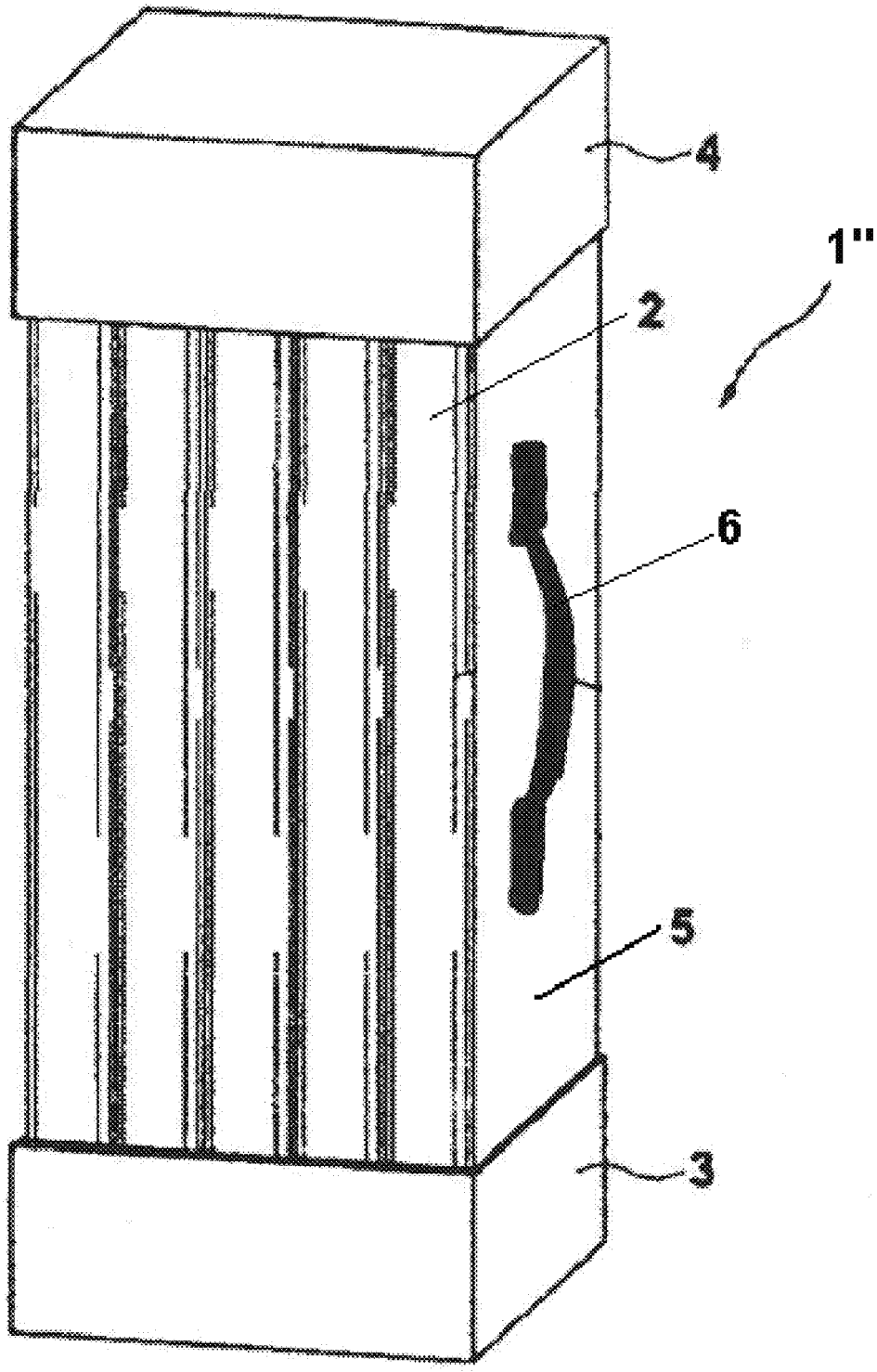
Figure 4:
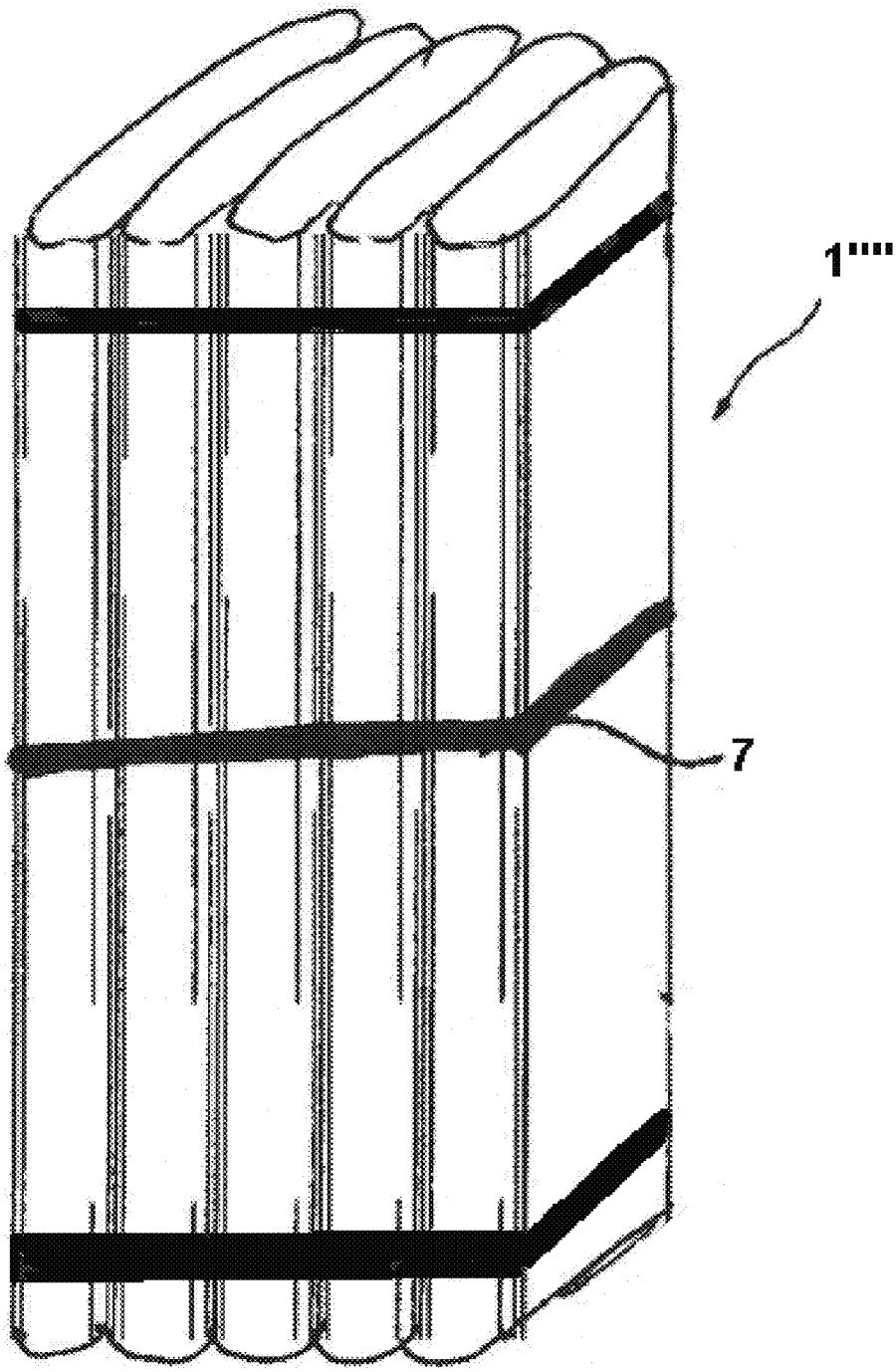
Figure 5:
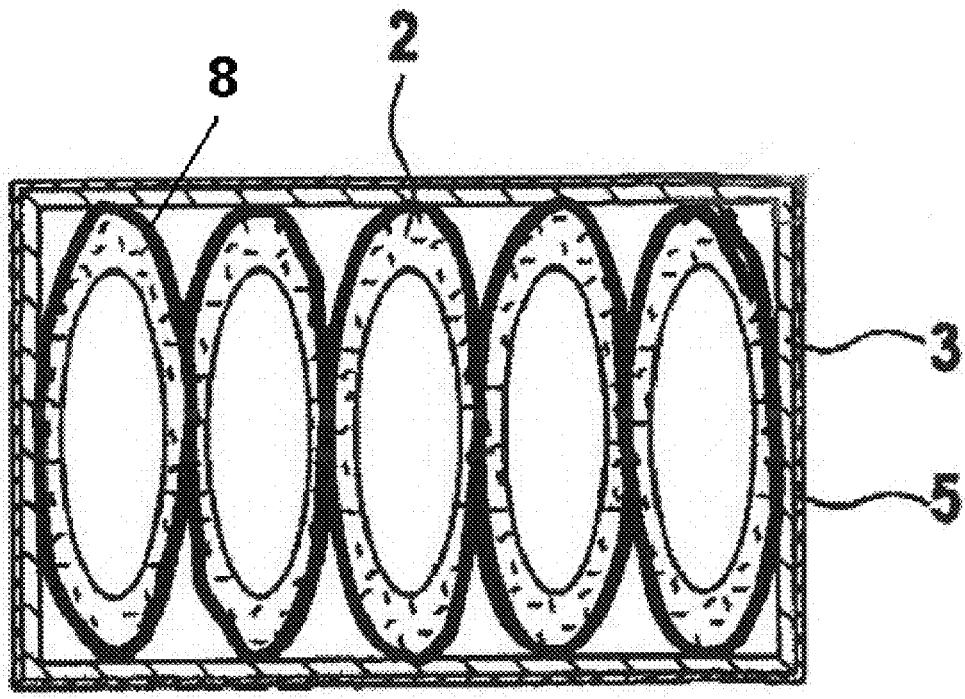

Further characteristics features and advantages of the object of the present invention become clear from the following detailed description of a sample embodiment and the drawing, in which FIG. 1 is a packaging unit containing five pipe sections, FIG. 2 is a horizontal section through the packaging unit in accordance with claim 1, FIG. 3 is a second embodiment of a packaging unit including a handle, FIG. 4 is a third embodiment of a packaging unit including multiple banderols, and FIG. 5 is a packaging unit including aluminum foil around the pipe sections.

In FIG. 1 may be seen a schematic drawing of a sample embodiment of a packaging unit 1 with five pipe sections 2. Pipe sections 2 have in the unpackaged state a circular cross-section, which, through incorporation into two cardboard covers 3, 4 and the packaging film 5 (only implied in FIG. 1) surrounding these and pipe sections 2, has been reduced to an elliptical shape (see FIG. 2). Packaging film 5 is made from polyethylene, which, after having been slipped over cardboard covers 3, 4 and pipe sections 2, was shrunk by means of the application of heat and thus exerts a pressure on pipe sections 2 and cardboard covers 3, 5 such that pipe sections 2, cardboard covers 3, 4 and packaging film 5 together form packaging unit 1.

Folded pipe sections 2 are arranged directly behind each other in a line (see FIG. 2) in the folding direction and their end faces are each covered jointly by cardboard 3, 4, which also enfolds part of the circumferential sides of the pipe sections. Cardboard covers 3, 4 have a box shape such that, for packaging unit 1, a quadratic shape results, which may be easily stacked on all sides.

In the unfolded state, pipe sections 2 have a length of 1 m, an outside diameter of 17 cm and the wall thickness is 2 cm. In packaging unit 1, pipe sections 2 are folded elliptically, with one axis having an outside dimension of roughly 6 cm, while the other axis has an outside dimension of roughly 25 cm. The volume of packaging unit 1 is 25 cm×(5×6 cm)×1 m=0.075 $m^3$. Unfolded pipe sections 2 have a volume of 17 cm×(5×17 cm)×1 m=0.1445 $m^3$. The volume reduction is therefore roughly 48%.

It may be easily seen that pipe sections 2 were not completely folded together, rather an inner cavity of 2 cm width remains. On account of the quality of the employed mineral wool with a composition complying with EP 03 02 2609, pipe sections 2 may be folded even further, without destruction of the mineral fibres setting in at the points of folding. Trials have confirmed that pipe sections 2 of this material build up adequate elastic recovery forces over a long period as well such that, following removal from packaging unit 1, pipe sections 2 return to their original shape and can be used immediately and without further processing stages, such a stretching and shaping, e.g. in a chimney, for insulation.

If maximum folding without compression of the mineral fibres is exploited, i.e. folding without inner cavity, the outside dimension of the one axis in the embodiment presented is accordingly 4 cm, while the outside dimension of the other axis is still practically unchanged at around 25 cm. The volume of packaging unit 1 is then 25 cm×(5×4 cm)×1 m=0.05 $m^3$ and the volume reduction then amounts to roughly 65%, a figure which corresponds to a total "degree of compression" of 1 : 2.89.

Naturally, other contingents of pipe sections 2 may be combined into a packaging unit 1, e.g. 3 or 4, such that a consumer can acquire suitable lengths of insulation in a non-complicated fashion and without large quantities of surplus material. Furthermore, packaging unit 1 of the invention is also suitable for every other pipe section dimension and cross-sectional shape if pipe sections 2 are able to form just adequate elastic recovery forces to restore their original shape.

FIGS. 3-4 show alternate embodiments of the packaging unit 1. As shown in FIG. 3, packaging unit 1" may include a carrying handle attached to packaging film 5. As shown in FIG. 4, more than one banderol 7 may be used to form packaging unit 1"". For example, three banderols 7 may be used to limit the undesirable bulging effects of the packaged pipe sections 2.

FIG. 5 shows aluminum foil 8 laminated to the exterior of the pipe sections 2. The aluminum foil 8 may be laminated to only the exterior, to the exterior and interior, or to only the interior of pipe sections 2. The aluminum foil 8 serves to protect pipe sections 2 when lying directly against each other. The aluminum foil 8 also facilitates the insertion or accommodation of at least one folded pipe section 2 in the cavity of an unfolded pipe section 2.

The outcome of the deliberations above is that, with the aid of packaging unit 1 of the invention, several pipe sections 2 can be transported and stored very economically. In this connection, pipe sections 2 are not restricted in their functionality, but, after removal from packaging unit 1, may be used directly and without restriction, e.g., to insulate chimneys.

The invention claimed is:

1. A packaging unit (1) comprising:

at least three pipe sections (2) of mineral wool, the pipe sections being elastic and having a relaxed uncompressed state and a compressed state, each pipe section having a pipe cavity, all of the pipe sections arranged side-by-side in a single line, all of the pipe sections compressed in a single direction defined by the line, the pipe sections each having a middle portion; and packaging consisting of:

a first cardboard box section (3) surrounding a first end of the pipe sections on five sides;

a second cardboard box section (4) surrounding a second end of the pipe sections on five sides, the pipe sections being compressed by the first and second cardboard box sections with reduction of the pipe section cavities and with stored recovery forces for restoring the pipe sections to the uncompressed state, the first cardboard box section spaced from the second cardboard box section so that the middle portions of the pipe sections are uncovered from rigid structure, the first and second box sections and the pipe sections forming a quadratic structure; and a plastic film (5) around the pipe sections and the first and second cardboard box sections.

2. A packaging unit (1) as defined by claim 1 wherein the plastic film is attached by film bonding.

3. A packaging unit (1) as defined by claim 1 wherein the plastic film comprises a shrink-wrap film.

4. A packaging unit (1) as defined by claim 1 wherein the pipe sections in the uncompressed state have a circular, oval or rectangular cross-sectional shape.

5. A packaging unit (1) as defined by claim 4 wherein the pipe sections assume an elliptical cross-section in the compressed state.

6. A packaging unit (1) as defined by claim 1 comprising three, four or five of the pipe sections.

7. A packaging unit (1) as defined by claim 1 wherein the pipe sections are laminated with aluminium film.

8. A packaging unit (1) as defined by claim 1 wherein a first pipe section in the compressed state is capable of being accommodated or inserted in the cavity of a second pipe section in the uncompressed state.

9. A packaging unit (1) comprising:

at least three pipe sections (2) of mineral wool, the pipe sections being elastic and having a relaxed uncompressed state and a compressed state, each pipe section having a pipe cavity, all of the pipe sections arranged side-by-side in a single line, all of the pipe sections compressed in a single direction defined by the line, the pipe sections each having a middle portion; and packaging consisting of:

a first cardboard box section (3) surrounding a first end of the pipe sections on five sides;

a second cardboard box section (4) surrounding a second end of the pipe sections on five sides, the pipe sections being compressed by the first and second cardboard box sections with reduction of the pipe section cavities and with stored recovery forces for restoring the pipe sections to the uncompressed state, the first cardboard box section spaced from the second cardboard box section so that the middle portions of the pipe sections are uncovered from rigid structure, the first and second box sections and the pipe sections forming a quadratic structure;

a plastic film (5) around the pipe sections and the first and second cardboard box sections; and a handle connected to the plastic film.

* * * * *